US006894018B1

(12) United States Patent
Beimesch et al.

(10) Patent No.: US 6,894,018 B1
(45) Date of Patent: May 17, 2005

(54) PROCESS FOR MAKING GRANULAR DETERGENT IN A FLUIDIZED BED GRANULATOR HAVING RECYCLING OF IMPROPERLY SIZED PARTICLES

(75) Inventors: Wayne Edward Beimesch, Covington, KY (US); Scott William Capeci, North Bend, OH (US); G. Gregory Spontak, Loveland, OH (US); Matthew Israel Wasserman, Princeton, NJ (US); Robert Gary Welch, Newcastle (GB)

(73) Assignee: The Procter & Gamble Company, Cincinnati, OH (US)

( * ) Notice: Subject to any disclaimer, the term of this patent is extended or adjusted under 35 U.S.C. 154(b) by 353 days.

(21) Appl. No.: 09/980,326

(22) PCT Filed: Jun. 20, 2000

(86) PCT No.: PCT/US00/16914

§ 371 (c)(1),
(2), (4) Date: Nov. 30, 2001

(87) PCT Pub. No.: WO00/78907

PCT Pub. Date: Dec. 28, 2000

Related U.S. Application Data

(60) Provisional application No. 60/140,079, filed on Jun. 21, 1999.

(51) Int. Cl.[7] ..... C11D 11/00
(52) U.S. Cl. ..... 510/444; 23/313 FB
(58) Field of Search ..... 510/444; 23/313 FB

(56) References Cited

U.S. PATENT DOCUMENTS

| | | | | |
|---|---|---|---|---|
| 4,726,908 | A | * | 2/1988 | Kruse |
| 4,828,721 | A | * | 5/1989 | Bollier et al. |
| 4,832,700 | A | | 5/1989 | Kaspar et al. |
| 4,846,409 | A | | 7/1989 | Kaspar et al. |
| 5,160,657 | A | | 11/1992 | Bortolotti et al. |
| 5,489,392 | A | * | 2/1996 | Capeci et al. |
| 5,628,800 | A | | 5/1997 | Schlicht et al. |
| 5,629,275 | A | | 5/1997 | Bauer et al. |
| 5,665,691 | A | | 9/1997 | France et al. |
| 5,929,021 | A | | 7/1999 | Dhanuka et al. |
| 6,056,905 | A | * | 5/2000 | Akkermans et al. |
| 6,136,777 | A | | 10/2000 | DelGreco et al. |
| 6,143,711 | A | | 11/2000 | DelGreco et al. |
| 6,274,544 | B1 | | 8/2001 | Akkermans et al. |

FOREIGN PATENT DOCUMENTS

| | | | |
|---|---|---|---|
| DE | 195 24 287 | A1 | 1/1997 |
| DE | 44 35 743 | C2 | 11/1998 |
| DE | 197 50 424 | A1 | 5/1999 |
| EP | 0 353 976 | A1 | 2/1990 |
| EP | 0 625 923 | B1 | 7/1995 |
| WO | WO 97/22685 | A1 | 6/1997 |
| WO | WO 97/28246 | A1 | 8/1997 |
| WO | WO 98/14551 | A1 | 4/1998 |
| WO | WO 99/00475 | A1 | 1/1999 |
| WO | WO 99/03964 | * | 1/1999 |

* cited by examiner

*Primary Examiner*—Margaret Einsmann
(74) *Attorney, Agent, or Firm*—Brahm J. Corstanie; Brian M. Bolam; Kim William Zerby

(57) ABSTRACT

A process for the production of granular detergent compositions is provided wherein fluid bed granulation is employed in conjunction with selected recycle of oversized particles to control the uniformity of the resulting detergent composition. The process comprises feeding starting ingredients into a fluid bed granulator to at least partially granulate the feed material while employing the fluid bed to control undersized particle generation and sizing in conjunction with recycle to control oversized particles.

13 Claims, No Drawings

PROCESS FOR MAKING GRANULAR DETERGENT IN A FLUIDIZED BED GRANULATOR HAVING RECYCLING OF IMPROPERLY SIZED PARTICLES

This application claims the benefit of Provisional application Ser. No. 60/140,079 filed Jun. 21, 1999.

FIELD OF THE INVENTION

The present invention relates to an improved process for making granular detergent compositions which have superior solubility, especially in cold temperature laundering solutions (i.e., less than about 30° C.), excellent flow properties (even after storage), and aesthetics/appearance. More particularly, the present process relates to the manufacture of detergent compositions via the use of a fluidized bed granulator having recycle of improperly sized particles.

BACKGROUND OF THE INVENTION

Recently, there has been considerable interest within the detergent industry for laundry detergents which have the convenience, aesthetics and solubility of liquid laundry detergent products, but retain the cleaning performance and cost of granular detergent products. The problems, however, associated with past granular detergent compositions with regard to aesthetics, solubility, flowability after standard storage conditions and user convenience are formidable. Such problems have been exacerbated by the advent of "compact" or low dosage granular detergent products which typically do not dissolve in washing solutions as well as their liquid laundry detergent counterparts. These low dosage detergents are currently in high demand as they consume resources and can be sold in small packages which are more convenient for consumers prior to use, but less convenient upon dispensing into the washing machine as compared to liquid laundry detergent which can be simply poured directly from the bottle as opposed to "scooped" from the box and then dispensed into the washing solution.

As mentioned, such low dosage or "cornpact" detergent products unfortunately experience dissolution problems, especially in cold temperature laundering solutions (i.e., less than about 30° C.). More specifically, poor dissolution results in the formation of "clumps" which appear as solid white masses remaining in the washing machine or on the laundered clothes after conventional washing cycles. These "clumps" are especially prevalent under cold temperature washing conditions and/or when the order of addition to the washing machine is laundry detergent first, clothes second and water last (commonly known as the "Reverse Order Of Addition" or "ROOA"). Such undesirable "clumps" are also formed if the consumer loads the washing machine in the order of clothes, detergent and then water. Similarly, this clumping phenomenon can contribute to the incomplete dispensing of detergent in washing machines equipped with dispenser drawers or in other dispensing devices, such as a granulette. In this case the undesired result is undissolved detergent residue in the dispensing device.

It has been found that the at least a portion of the dissolution profile of a granular detergent composition is impacted by the process used to manufacture that detergent. For instance, the dissolution profile of a detergent composition may be impacted by the uniformity of the particles in the composition with respect to both density and size of the particles. This uniformity in turn is dictated in large part by the process by which the detergent is manufactured. However, to date manufacturing processes have been largely unsatisfactory in delivering compositions of the desired uniformity.

Accordingly, the need remains for a process for the manufacture of detergent compositions which can provide compositions of the desired uniformity and as such exhibits improved solubility, is more aesthetically pleasing to consumers, has improved flowability and exhibits improved cleaning performance.

SUMMARY OF THE INVENTION

This need has been met by the present invention wherein a process for the manufacture of a detergent composition in a fluidized bed granulator with selected recycle of the improperly sized particles is provided. The present invention meets the aforementioned needs by controlling the size of the particles within the process to a greater extent than current detergent manufacturing processes. Via the present invention the amount of undersized particles or fines present in a detergent composition are reduced via the use of fluidized bed granulation and the amount of oversized particles are also reduced via the screeing and re-introduction of these oversized particles to the process. The result is a detergent composition with improved solubility or dissolution in laundering solutions, especially in solutions kept at cold temperatures (i.e., less than about 30° C.), is aesthetically pleasing to consumers and has improved flowability.

In accordance with a first aspect of present invention, a process for making a granular detergent composition is provided. The process comprising the steps of:

a) providing a granular feed stream;

b) passing the granular feed stream into a fluidized bed granulator;

c) at least partially agglomerating the feed stream in the fluidized bed granulator to form detergent agglomerates;

d) screening the detergent agglomerates to separate oversized particles from properly sized particles; and e) re-introducing oversized particles to the process. The process may comprise various alternative scenarios such as re-introduction to any combination of the fluid bed or, when present, to a pre-mixer or finishing step. The oversized particles may be optionally milled or ground before re-introduction to the process. Undersized particles may be removed from the fluidized bed and re-introduced to the process such as to the pre-mixer or fluidized bed or may be re-circulated within the fluid bed via the use of an internally recycling fluidized bed.

Accordingly, it is an advantage of the invention to provide a process for making granular detergent compositions which exhibit improved solubility, are more aesthetically pleasing to consumers, have improved flowability and exhibit improved cleaning performance. It is a further advantage of the present invention to provide a process for making a granular detergent composition wherein selected recycle of improperly sized particles is employed to provide a more uniform detergent composition.

DETAILED DESCRIPTION OF THE PREFERRED EMBODIMENTS

As used herein, the word "particles" means the entire size range of a detergent final product or component or the entire size range of discrete particles, agglomerates, or granules in a final detergent product or component admixture. It specifically does not refer to a size fraction (i.e., representing less than 100% of the entire size range) of any of these types of particles unless the size fraction represents 100% of a discrete particle in an admixture of particles. For each type of particle component in an admixture, the entire size range of discrete particles of that type have the same or substantially similar composition regardless of whether the particles are in contact with other particles. For agglomerated components, the agglomerates themselves arc considered as discrete particles and each discrete particle may be comprised of a composite of smaller primary particles and binder compositions.

As used herein, the phrase "geometric mean particle diameter" means the geometric mass median diameter of a set of discrete particles as measured by any standard mass-based particle size measurement technique, preferably by dry sieving. As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$); See Gotoh et al. *Powder Technology Handbook*, pp. 6–11, Marcel Dekker 1997.

As used herein, the phrase "builder" means any organic or inorganic material having "builder" performance in the detergency context. and specifically, organic or inorganic material capable of removing water hardness from washing solutions and/or having dispersion or peptization properties. As used herein, the term "bulk density" refers to the uncompressed, untapped powder bulk density, as measured by pouring an excess of powder sample through a funnel into a smooth metal vessel (e.g., a 500 ml volume cylinder), scraping off the excess from the heap above the rim of the vessel, measuring the remaining mass of powder and dividing the mass by the volume of the vessel.

As used herein, "composition" and "granular detergent composition" are intended to include both final products and additives/components of a detergent composition. That is, the compositions produced by the processes claimed herein may be complete laundry detergent compositions or they may be additives that are used along with other detergent ingredients for laundering fabrics and the like.

The present invention is directed toward the use of selected recycle streams of improperly sized particles to advantageously produce a detergent that is more uniform in appearance and presents improved dissolution and aesthetic features as well. Via the use of a fluidized bed to control undersized particles and screening and reintroduction of oversized particles superior detergent compositions are produced.

In general, the process of the present invention comprises the addition of a granular feed stream into a fluidized bed granulator to achieve at least partial granulation of the feed stream. Of course, one of ordinary skill in the art will recognize that multiple feed streams are possible within the scope of the present invention. The feed stream of the present invention may comprise granules of conventional detergent adjunct ingredients, wet detergent agglomerates, dry detergent agglomerates or spray-dried detergent granules. Detergent adjunct ingredients includes but is not limited to, carbonates, phosphates, sulfates, zeolites or the like. Of course, other conventionally known ingredients may be included as well. Spraycied detergent granules include those particles which are manufactured via a conventional spray drying technique wherein a slurry of detergent materials is prepared and sprayed downward into a upwardly flowing stream of gas to dry the particles. A dry free flowing material is produced from the process. Wet detergent agglomerates includes those particles that are manufactured via a granulation type process wherein detergent adjunct ingredients such as described above are admixed with a liquid binder material such as a surfactant or precursor thereof in a mixer or series of mixer to forn granules of detergent materials. These particles are known as "wet agglomerates" until dried and as dry agglomerates upon exiting a drying and optionally a conditioning stage. The conditioning stage may include sizing, grinding and cooling stages in any combination. Granulation processes are well known in the detergent art. Some non-limiting examples include the process as described in U.S. Pat. Nos. 5.489.392, 5,516.448 to Capeci et al the disclosures of which are herein incorporated by reference.

Accordingly, the present invention entails the introduction of both raw material ingredients to form a detergent agglomerate or the introduction of previously formed detergent granules for continued processing of the granules. In a preferred embodiment of the present invention, the granular feed stream comprises at least two of the differing types of granules such as spray-dried granules and wet or dry detergent agglomerates. In one highly preferred embodiment, the feed stream is comprised of spray-dried detergent granules, dry detergent agglomerates and detergent adjunct ingredients.

Optionally, the granular feed stream may be processed to remove particles having geometric mean particle diameter of from about 500 microns to about 1500 microns with a geometric standard deviation of from about 1 to about 2. These "in-spec" particles can be fed directly to the resulting granular detergent composition. The processing of the feed streams can be accomplished by, for example "screening", to remove the particles that have the desired geometric mean particle diameter. By feeding these "in-spec" particles directly to the resulting granular detergent composition, the granular detergent making process is by-passed. This reduces the load on the granular detergent making equipment and increases the yield of particles within the desired size range.

The fluidized bed granulator comprises a fluid bed dryer into which a detergent binder is added to agglomerate particles within the fluid bed. As stated earlier, the fluid bed of the present invention contributes to the overall uniformity of the detergent of the present invention via the granulation of the undersized particles. Undersized or "fine particles" are defined as particles that have a geometric mean particle diameter that is less than about 1.65 standard deviations below the chosen geometric mean particle diameter of the granular detergent composition at a given span or geometric standard deviation. Oversized or large particles may also exist wherein "large particles" are defined as particles that have a geometric mean particle diameter that is greater than about 1.65 standard deviations above the chosen geometric mean particle diameter of the granular detergent composition at a given span or geometric standard deviation.

While not wishing to be bound by theory, it is believed that the undersized particles of the present invention are significantly reduced via the use of fluid bed granulation. Undersized particles are fluidized and circulated within the bed where they come into contact with the liquid binder material sprayed into the fluid bed. As the undersized particles circulate within the bed at a higher rate than other particles, these undersized particles come into contact with the binder material at a higher rate. Accordingly, the undersized particles are agglomerated or bound to other particles thereby reducing the total number of undersized particles.

Via the use of fluidized bed granulation, the amount of undersized particles are reduced by as much as 10% more preferably 25% than conventional detergent processing techniques.

Undersized particles remaining after the fluid bed granulation step of the present invention may then be separated from the granular detergent during the process and re-introduced to the process. The undersized particles may be extracted from the process via elutriation from the exhaust gases of the fluidized bed or via other conventional processing means such as an air lift or screen. These undersized particles may then be added to any unit operation in the process. These unit operation may include a premixer or series of premixers, fluid bed granulator, fluid bed coater, fluid bed or bulk heat exchanger for cooling, grinder or milling equipment for oversize and screens used for sieving. In this manner, the process may be controlled for optimum reduction of undersized particles by selectively re-introducing the particles to various processing steps where they may be agglomerated to build size of the particles. Alternatively, undersized particles are controlled via the use of an internally recirculating fluidized bed wherein undersized particles are captured before exiting the fluidized bed and remain within the bed until agglomerated to acceptable sizes.

Preferably, the fluid bed granulator of the present invention has multiple internal "stages" or "zones". A stage or zone is any discrete area within the fluid bed, and these terms are used interchangeably herein. The process conditions within a stage may be different or similar to the other stages in the fluid bed. It is understood that two adjacent fluid beds are equivalent to a single bed having multiple stages. The granular feed stream is at least partially agglomerated within the fluid bed via the addition of a liquid binder material to the fluid bed. The granular feed stream or streams can be sized and split if desired and added at different stages, depending on, for example, the particle size and moisture level of the feed stream. Feeding different streams to different stages can minimize the load on the fluid bed, and optimize the particle size and shape as defined herein. Liquids are typically added to a bed through nozzles above or within the product flowing through the bed, and the nozzles can spray upward, across or downward depending on their position within the fluid bed. Manufacturers of such fluidized beds include Niro, Bepex, Spray Systems and Glatt.

The liquid binder material is added for purposes of enhancing granulation by providing a "binding" or "sticking" agent for the detergent components such as undersized particles. The binder is preferably selected from the group consisting of water anionic surfactants and their precursors, nonionic surfactants, polyethylene glycol, polyinyl pyrrolidone, polyacylates, citric acid and mixtures thereof. Other suitable binder materials including those listed herein are described in Beerse et al, U.S. Pat. No. 5.108.646 (Procter & Gamble Co.), the disclosure of which is incorporated herein by reference.

Typical conditions within a fluidized bed granulator of the present invention include (i) from about 1 to about 20 minutes of mean residence time, (ii) from about 100 to about 600 mm of depth of unfluidized bed, (iii) a droplet spray size of less than 2 times the particles size, preferably not more than about 100, more preferably not more 50 micron, (iv) from about 150 to about 1600 mm of spray height from the fluid bed plate, (v) from about 0.1 to about 4.0 m/s of fluidizing velocity, preferably about 1.0 to about 3.0 m/s and (vi) from about 12 to about 200° C. of bed temperature, more preferably 15–100° C. Once again, one of ordinary skill in the art will recognize that the conditions in the fluid bed may vary depending on a number of factors.

The fluid bed granulator of the present invention is preferably operated such that it has a flux number of from about 2.5 to about 4.5. Flux number (FN) is a ratio of the excess velocity ($U_e$) of the fluidization gas and the particle density ($p_p$) relative to the mass flux ($q_{liq}$) of the liquid sprayed into the bed at a normalized distance ($D_o$) of the spraying device. The flux number provides an estimation of the operating parameters of a fluidized bed to control granulation within the bed. The flux number may be expressed either as the mass flux as determined by the following formula:

$$FN_m = \log_{10}[\{P_p U_e\}/q_{liq}]$$

or as the volume flux as determined by the formula:

$$FN_v = \log_{10}[\{U_e\}/q_{viq}]$$

where $q_{viq}$ is the volume of spray into the fluid bed. Calculation of the flux number and a description of its usefulness is fully described in WO 98/58046 the disclosure of which is herein incorporated by reference.

In addition, the fluid bed granulator of the present invention is preferably operated such that it has a Stokes number of less than one (1), more preferably from about 0.1 to about 0.5. The Stokes number is a measure of particle coalescence for describing the degree of mixing or agglomerating occurring to particles in a piece of equipment such as the fluid bed. The Stokes number is measured by the formula:

$$\text{Stokes number} = 4pvd/9u$$

wherein p is the apparent particle density, v is the excess velocity, d is the mean particle diameter and u is the viscosity of the binder. The Stokes number and a description of its usefulness is described in detail in WO 99/03964, the disclosure of which is herein incorporated by reference.

Optionally, the feed stream of present invention can be processed in at least one pre-mixer before the addition of the feed stream to the fluidized bed granulator to form detergent premix. The pre-mixer may be one or a series of low, moderate or high speed mixers as is conventionally known in the art. The particular mixer used in the present process should preferably include pulverizing or grinding and granulation tools although such tools are not required. To that end, it has been found that the preferred process of the present invention employs as a pre-mixer a Lodige KM™ (Ploughshare) moderate speed mixer, Lodige CB™ high speed mixer, or mixers made by Fukae, Drais, Schugi or similar brand mixer. The Lodige KM™ (Ploughshare) moderate speed mixer, which is a preferred mixer for use in the present invention, comprises a horizontal, hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. The grinding or pulverizing is accomplished by cutters, generally smaller in size than the rotating shaft, which preferably operate at about 3600 rpm. Other mixers similar in nature which are suitable for use in the process include the Lodige Ploughshare™ mixer and the Drais® K-T 160 mixer. Generally, in the process of the present invention, the shear will be no greater than the shear produced by a Lodige KM mixer with a tip speed of the ploughs below 30 m/s or even below 10 m/s or even lower.

The detergent agglomerates from the fluidized bed granulator may be further processed, if necessary to dry or cool the agglomerated particles.

Preferably, the mean residence time of the various detergent ingredients in the low, moderate or high speed mixer is preferably in range from about 0.1 seconds to about 30 minutes, most preferably the residence time is about 0.1 seconds to about 5 minutes. In this way, the density of the resulting detergent agglomerates is at the desired level.

The processes of this invention may comprise the step of spraying an additional binder material as hereinbefore described in the pre-mixer or series of pre-mixers in order to enhance granulation of the various materials in the feed stream.

In an optional embodiment of the present invention the process may additionally include a finishing step including but not limited to, admix and/or spray-on of additional ingredients such as enzymes, bleach perfumes, etc or a packaging step.

Upon exiting from the fluid bed granulator (or any suitable stage therein), the detergent agglomerates may be sized to separate oversized particles from detergent agglomerates in the desired range. The oversized particles may be sized according to conventionally known technology such as via screening. The oversized particles are then re-introduced into the process at appropriate locations in order to achieve the more uniform detergent composition as disclosed herein. Via the control of oversized particles in conjunction with the undersized particles as described hereinbefore, a detergent process for producing a superior performing detergent composition is controlled. As mentioned previously, the control of these oversized particles leads to better overall properties of the composition such as particle density and span as described herein which contribute to the overall superiority of the detergent composition.

Preferably, but by no means required, the oversized particles may be optionally milled or ground before re-introduction to the process. The milling or grinding may be preformed in conventional grinding equipment as is well known in the art of detergent processing. The oversized particles may be re-introduced to the process to any desired stage suitable for control of the process such as the fluid bed, the pre-mixer or series of pre-mixers or the finishing step, when present. The oversized particle stream may be split and particles re-introduced into a combination of locations disclosed above. In preferred embodiments of the present invention, the oversized particles are passed through a grinding step where the ground product is once again sized and acceptable particles passed through to a coating step as described herein or to the resulting final detergent composition while the improperly sized particles are re-introduced to process as described above. In preferred embodiments, the oversized particles are re-introduced into the pre-mixer or series of pre-mixers.

In an optional embodiment, the feed stream may be sized as well before entering the fluid bed granulator. When an optional pre-mixer or series of pre-mixers is present, the sizing may occur before or after any or all of the pre-mixers. Thus, oversized particles may be removed at any stage of the process. These oversized particles may then be combined for re-introduction into the process, particularly after a preferred grinding or milling step. Of course, one of ordinary skill in the art will recognize that by re-introduction into a mixer of the present invention for both undersized and oversized particles, it is intended to include re-introduction to the feed streams entering the mixer or granulator in question as well re-introduction directly into the mixer or granulator.

The particles of this invention may be further processed in an optional step by adding a coating agent to improve the particle color, increase the particle "whiteness", or improve the particle flowability after the particles exit the mixer or the driver to obtain the granular detergent composition produced by the present invention. Coating agents herein may include dry inorganic materials such as zeolites, carbonates, sulfates etc. Alternatively, the coating process may include the spray of a liquid coating agents such as anionic surfactant, slurries or solutions of inorganic or organic salts, and various other materials. Those skilled in the art will appreciate that a wide variety of methods may be used to dry as well as cool the exiting detergent particles without departing from the scope of the invention. Since the mixer can be operated at relatively low temperatures, the need for cooling apparatus is not required by the present process, which thereby further reduces manufacturing costs of the final product.

Another optional processing step includes continuously adding a coating agent such as zeolites and fumed silica to the mixer to facilitate free flowability of the resulting detergent particles and to prevent over granulation.

The granular detergent composition achieves the desired benefits of solubility, improved aesthetics and flowability via the process of the present invention and the control or selection of the geometric mean particle diameter of certain levels of particles in the composition. By "improved aesthetics", it is meant that the consumer prefers a granular detergent product which has a more uniform appearance of particles as opposed to past granular detergent products which contained particles of varying size and composition. To that end, at least about 50%, more preferably at least about 75%, even more preferably at least about 90%, and most preferably at least about 95%, by weight of the total particles in the detergent product, have the selected mean particle size diameter. In this way, a substantial portion of the granular detergent product will have the uniform size so as to provide the aesthetic appearance desired by consumers.

Preferably, the geometric mean particle diameter of the particles is from about 500 microns to about 1500 microns, more preferably from about 600 microns to about 1200 microns, and most preferably from about 600 microns to about 1000 microns. The particle size distribution is defined by a relative tight geometric standard deviation or "span" so as not to have too many particles outside of the target size. Accordingly, the geometric standard deviation is preferably from about 1 to about 2, more preferably is from about 1.0 to about 1.7, even more preferably is from about 1.0 to about 1.4, and most preferably is from about 1.0 to about 1.2. The bulk density of the particles is preferably in the range of from about 400 g/L to about 850g(L, more preferably from about 550 g/l to about 800 g/l and even more preferably from about 600 g/L to about 750 g/L. As can be recognized by one of ordinary skill in the art, the control of improperly sized particles via the present invention contributes to the tight span of the composition produced by the present invention.

while not intending to be bound by theory, it is believed that solubility and compositional quality are enhanced as a result of the particles in the detergent composition being more of the same size. Specifically, as a result of the particles being more uniform in size, the actual "contact points" among the particles in the detergent composition is reduced which, in turn, reduces the "bridging effect" commonly associated with the "lumpgel" dissolution difficulties of granular detergent compositions. Previous granular detergent compositions contained particles of varying sizes which leads to more contact points among the particles. For example, a large particle could have many smaller particles in contact with it rendering the particle site ripe for lump-gel formation. The level and uniform size of the particles in the granular detergent composition of the present invention avoids such problems.

By "a portion" of the particles, it is meant that at least some particles in the detergent composition contain a detersive surfactant and/or a detergent builder to provide the fundamental building blocks of a typical detergent composition. The various surfactants and builders as well as their respective levels in the composition are set forth hereinafter. Typically, the detergent composition will contain from about 1% to about 50% by weight of a detersive surfactant and from about 1% to about 75% by weight of a detergent builder.

A particularly important attribute of detergent powders is color. Color is usually measured on a Hunter Colorimeter and reported as three parameters "L", "a" and "b". Of particular relevance to the powdered detergent consumer is the whiteness of the powder determined by the equation L-3b. In general, whiteness values below about 60% are considered poor. Whiteness can be improved by a number of means known to those of ordinary skill in the art. For example, coating granules with Titanium Dioxide.

Preferably the granular detergents of this invention have whitenesses of 60–100, preferably 75–100, more preferably, 85–100 and most preferably 92–100. Also preferred are granular detergents where all components have a whiteness difference (maximum - minimum) of less than about 40, preferably less than 30, more preferably less than 20 and most preferably less than 10.

Another important attribute of the granular detergent products of this invention is the shape of the individual particles. Shape can be measured in a number of different ways known to those of ordinary skill in the art. One such method is using optical microscopy with Optimus (V5.0) image analysis software. Important calculated parameters are:

"Circularity" which is defined as (measured perimeter length of the particle image)$^2$/(measured area of the particle image). The circularity of a perfectly smooth sphere (minimum circularity) is 12.57; and "Aspect Ratio" which is defined as the length/width of the particle image.

Each of these attributes is important and can be averaged over the bulk granular detergent composition. And the combination of the two parameters as defined by the product of the parameters is important as well (i.e. both must be controlled to get a product with good appearance). Preferably, the granular detergent compositions produced by the process of the present invention have circularities less than about 50, preferably less than about 30, more preferably less than about 23, most preferably less than about 18. Also preferred are granular detergent compositions with aspect ratios less than about 2, preferably less than about 1.5, more preferably less than about 1.3 most preferably less than about 12.

Additionally, it is preferred to have a uniform distribution of shapes among the particles in the composition. Specifically, the granular detergent compositions of this invention have a standard deviation of the number distribution of circularity less than about 20, that is preferably less than about 10, more preferably less than about 7 most preferably less than about 4. And the standard deviation of the number distribution of aspect ratios is preferably less than about 1, more preferably less than about 0.5, even more preferably less than about 0.3, most preferably less than about 0.2.

In an especially preferred process of the present invention, granular detergent compositions are produced wherein the product of circularity and aspect ratio is less than about 100, preferably less than about 50, more preferably less than about 30, and most preferably less than about 20. Also preferred are granular detergent compositions with the standard deviation of the number distribution of the product of circularity and aspect ratio of less than about 45, preferably less than about 20, more preferably less than about 7 most preferably less than about 2.

Detergent Components

The detergent composition of the present invention, preferably include surfactants such as anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat. No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimitig examples of surfactant systems include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^{-M+})$ $CH_3$ and $CH_3$ $(CH_2)_y$ $(CHOSO_3M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$-$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphotenc surfactants such as the $C_{12}$–$C_{18}$ alkyl ethoxylates ("AE") including the so-called narrow peaked alkyl ethoxylates and $C_6$–$C_{12}$ alkyl phenol alkoxylates.(especially ethoxylates and mixed ethoxy/propoxy), $C_{12}$–$C_{18}$ betaines and sulfobetaines ("sultaines"), $C_{10}$–$C_{18}$ anmine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$N-3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The detergent composition can, and preferably does, include a detergent builder. Builders are generally selected from the various water-soluble, alkali metal, ammonium or substituted ammoniumn phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates. and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the nonsoap anionic surfactant.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and hating a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Any number of additional ingredients can also be included as components in the granular detergent composition. These include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hatnat, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al., issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al., issued May 5, 1987, both incorporated herein by reference.

EXAMPLES

The following examples are presented for illustrative purposes only and are not to be construed as limiting the scope of the appended claims in any way.

EXAMPLE I

This example illustrates a process according to the present invention which produces uniformn, free flowing detergent granules with good dissolution profiles. Two feed streams of spray dried granules and dry agglomerates are continuously fed to a Lodige KM-600 moderate speed mixer at a rate of 600 Kg/hr at equal parts. 50 kg/hr of a solution of PEG 4000, 35 wt. % solids is added to the KM. The resulting granules are fed into a fluid bed granulator, dryer, cooler with a gas fluidization velocity of approxitnately 1.5 $m/s^2$. An additional 50 kg/hr of PEG 4000, 35 wt. % solids is sprayed in the fluid bed. The fluid bed is operated with a superficial velocity of 2.0 $m/s^2$ at the plate and a disengagement velocity of 1.4 $m/s^2$. Approximately, 50 kg/hr of undersized material is ellutriated in the fluid bed, collected in a baghouse and re-introduced to the KM-600 pre-mixer. Following the fluid bed, the product is passed through a Morgensen screener set up to remove particle larger than 1200 microns. The oversized particles are then ground in a mill and returned to the fluid bed granulator. The resulting product has a geometric mean particle diameter of 600 microns and a span of 1.4.

Having thus described the invention in detail, it will be obvious to those skilled in the art that various changes may be made without departing from the scope of the invention and the invention is not to be considered limited to what is described in the specification.

What is claimed is:

1. A process for making a granular detergent composition having a circularity less tha about 30, an aspect ratio less than about 1.3 and wherein the product of the circularity and aspect ratio is less that 30 comprising the steps of:

a) proving a granular feed stream comprising particles of spray dried granules and detergent agglomerates, and optional detergent adjunct ingredients;

b) passing said feed stream into a pre-mixer together with a binder to format a mixture;

c) b) passing said mixture from step b) into a fluidized bed granulator having a bed plate;

d introducing a binder into said fluidized bed granular in the form of droplets;

e) operating said fluidized bed granulator at a Stokes number less than 1 for about 1 to about 20 minutes residence time, at from abut 100 to about 600mm depth of unfluidized bed, at a droplet size not more than 100 microns, at about 150 to about 1600mm of spray height from the fluid bed plate, at from about 0.1 to about 4.0m/s of fluidizing velocity and from about 12 to about 200° C. bed temperature to form detergent agglomerates;

f) sizing said detergent agglomerates to separate oversized particles from said detergent agglomerates; and g) optionally, re-introducing said oversized particles to said process.

2. The process for making the granular detergent composition of claim 1, further comprising the step of milling said oversized particles before re-introduction into said process.

3. The process for making the granular detergent composition of claim 2, wherein said oversized particles are re-introduced into any unit operation in said process or into said fluid bed granulator.

4. The process for making the granular detergent composition of claim 1, further comprising the step of passing said granular feed stream through at least one pre-mixer before introduction into said fluid bad granulator and re-introducing at least a portion of said oversized particles to said pre-mixer.

5. The process for making the granular detergent composition of claim 4, wherein said granular feed stream is passed through at least two pre-mixers and at least a portion of said oversized particles are reintroduced in either or both of said pre-mixers.

6. The process for making the granular detergent composition of claim 2, further comprising the steps of passing said detergent agglomerates after step (f to a finishing step and re-introducing at least a portion of said oversized particles after milling to said finishing step.

7. The process as claimed in claim 1 further comprising the step of extracting undersized particles from said fluidized bed and re-introducing said undersized particles to said process.

8. The process as claimed in claim 7 further comprising the step of passing said granular feed stream through at least one pre-mixer before introduction into said fluid bed granulator and re-introducing at least a portion of said undersized particles to said at least one pre-mixer.

9. The process as claimed in claim 8, wherein said granular feed stream is passed though at least two pre-mixers and at least a portion of said oversized particles are reintroduced in either or both of said pre-mixers.

10. The process as claimed in claim 1 where said fluidized bed granulator is an internally re-circulating fluid bed and undersized particles are re-circulated internally within the fluidized bed.

11. The process as claimed in claim 5 further comprising the step of screening said granular feed stream upon exiting said pre-mixer to separate oversized particles and re-introducing said oversized particles to the process.

12. The process as claimed in claim 11 further comprising the step of passing said granular feed through at least two pre-mixers, screening said feed stream upon exiting either or both of said pre-mixers to separate oversized particles and re-introducing at least a portion of said oversized particles in either or both of said pre-mixers.

13. The process as claimed in claim 1 wherein said fluidized bed granulator is operated at a flux number within the range of from about 2.5 to about 45.

* * * * *